US007745684B2

(12) United States Patent
Huza et al.

(10) Patent No.: US 7,745,684 B2
(45) Date of Patent: Jun. 29, 2010

(54) ODOR CONTROL NETHER GARMENT, METHOD OF MAKING SAME AND METHOD OF CONTROLLING ODOR

(76) Inventors: James P. Huza, 1804 Plantation Cir., Greenville, NC (US) 27858; Sharron Ann Huza, 1804 Plantation Cir., Greenville, NC (US) 27858

( * ) Notice: Subject to any disclaimer, the term of this patent is extended or adjusted under 35 U.S.C. 154(b) by 9 days.

(21) Appl. No.: 11/097,811

(22) Filed: Apr. 1, 2005

(65) Prior Publication Data

US 2006/0191058 A1 Aug. 31, 2006

Related U.S. Application Data

(60) Provisional application No. 60/559,389, filed on Apr. 3, 2004.

(51) Int. Cl.
*A61F 13/15* (2006.01)
*A61F 13/20* (2006.01)

(52) U.S. Cl. ..... 604/359; 604/367

(58) Field of Classification Search ..... 604/358–360, 604/367

See application file for complete search history.

(56) References Cited

U.S. PATENT DOCUMENTS 2,038,242 A * 4/1936 Schwartz ..... 602/67
3,529,044 A * 9/1970 Santangelo ..... 264/29.2
4,182,335 A 1/1980 Matrullo
4,304,746 A * 12/1981 Yamada et al. ..... 264/103
4,490,145 A 12/1984 Campbell
4,714,649 A * 12/1987 Edwards ..... 442/197
4,880,417 A 11/1989 Yabrov
5,024,594 A * 6/1991 Athayde et al. ..... 442/67
5,281,504 A * 1/1994 Kanbayashi et al. ... 430/124.53
5,360,421 A 11/1994 Revelle
5,593,398 A 1/1997 Weimer
5,665,081 A 9/1997 Grosse
5,728,080 A 3/1998 Suyama
5,957,907 A 9/1999 Sauer
6,313,371 B1 11/2001 Conant et al.
7,073,223 B2 * 7/2006 Huza ..... 5/653
2003/0032556 A1 * 2/2003 Ouvry ..... 502/418

* cited by examiner

*Primary Examiner*—Michele Kidwell

(57) ABSTRACT

A nether garment for adsorbing odor to be worn close to at least one body part of a user having at least one outer fabric material layer and an inner layer of fiber fabric material for adsorbing odor, such that the nether garment conforms to a shape of the at least one body part of the user thereby providing one or more of a lightweight, flexible, breathable, washable, regenerative and reusable apparatus. Also described is a method of making an odor control nether garment and an improved method of controlling odors, including various body odors.

6 Claims, 8 Drawing Sheets

ODOR CONTROL NETHER GARMENT, METHOD OF MAKING SAME AND METHOD OF CONTROLLING ODOR

RELATED APPLICATIONS

This application claims the benefit of U.S. provisional patent application No. 60/559,389 filed on Apr. 3, 2004.

FIELD OF THE INVENTION

The present invention relates to an apparatus for controlling odors, including flatulence, genitalia and urine odors, a method of making the apparatus and a method of controlling odors.

BACKGROUND OF THE INVENTION

The average person produces two to three pints of gas daily, which exits the body from the anus in the form of flatus or from the mouth in the form of belching. On average, a flatus outburst for a normal person ranges from 10-20 occurrences per day and the odoriferous component consists mainly of sulfide gases. However, sufferers of, for example, irritable bowel syndrome, diabetes, diverticulitis, MS, aging and other gastrointestinal ailments can produce far more gas with more odors and emit it much more frequently. To minimize the effects of these flatus events, a wearable and regenerative odor control nether garment, incorporating air diffusion and odor adsorbing filtration technology, were developed to eliminate the inherent conflict between someone with odoriferous intestinal gas and the people within his or her breathing zone. Thus, the present invention relates to a gaseous intestinal discharge control apparatus and, more specifically, to an odor control apparatus which when worn close to the body of a user, adsorbs odoriferous intestinal gas and/or genitalia and/or urine and/or foot and/or under arm odor.

The use of activated carbon dates back to 1500 BC when it was discovered in an Egyptian papyrus and used for medicinal purposes. The ancient Hindus filtered water with carbon. In the thirteenth century, carbon materials were used in processes to purify sugar solutions. Late in the eighteenth century, Scheel discovered the gas adsorptive capabilities of carbon and Lowitz noted its ability to remove colors from liquids.

During World War I, activated carbon was used by the allies in gas masks to filter out chlorine gas. During Desert Storm, the allied military, under the threat of gas warfare, used garments impregnated with coconut shell carbon powder for protection.

Activated carbons are typically produced in granular, powdered and pelletized (a form of powdered) forms with the bulk made from coconut shells, coal, wood or peat materials, activated by selective oxidation with steam at elevated temperatures.

During the last few decades a third form of activated carbon was successfully developed by technically advanced countries, known as activated carbon fiber fabric. The raw materials used for making activated carbon fiber are typically Rayon® (cellulose), phenolic compounds and polyacrylonitrile (PAN). In general, the manufacture of PAN involves stabilizing the PAN in air up to 300° C. The resulting oxidized fiber can be directly activated or more usually is made into a fabric through conventional textile means. The oxidized PAN material is then activated. This involves heating the material to a temperature of up to 1300° C. not in an inert atmosphere but in an oxidizing atmosphere such as $CO_2$ or $H_2O$ (steam).

The action of the oxidizing agent causes a tremendous attack on the surface of the fibers, which induces a huge surface area, and a porous surface. The size and configuration of the pores greatly influence the adsorption capability of the carbon atoms on the surface to act as chemical "hooks" to attach many odoriferous gaseous substances, which are capable of passing through the PAN material. Also, a unique property of the activated carbon fiber fabric is that it is possible to reactivate the material when it becomes saturated, thus allowing the fiber fabric to be reused.

The adsorption speed of PAN activated carbon fiber can be from ten times to several hundred times that of granular or powdered activated carbon due to the size and configuration of the pores. Activated carbon fiber having a PAN precursor consists of micropores whereas macropores are predominant in granular/powdered carbons. The micropores are of a long and narrow shape resulting in a strong attractive force at the carbon surface, accelerating molecules into the pore structure so that efficient and rapid pore-filling continues, up to the point of saturation whereas in granular or activated powdered carbon some micropores exist at the very deep portion of the structure with the entrance to these pores being wide open. As a result, there is only a weak attraction at the surface thus requiring a long time for the molecules to diffuse to the point where they are captured and fixed.

The basic mechanism by which PAN activated carbon fiber fabric removes impurities from contaminated air is referred to as physical adsorption. Physical adsorption is a phenomenon caused by electrostatic forces of attraction (Van der Waal forces) between the impurities and the internal surfaces of the activated carbon. Adsorption differs from absorption in that adsorption is the binding of molecules to a surface and absorption is the filling of pores in a solid.

Activated carbon is not a single product but a variety of products, which can be distinguished by a number of qualitative parameters. The qualitative parameters of one carbon product may make it efficient and cost effective where another may fail in part or in whole. Some of the parameters of activated carbon are: porosity; weight of specific material expressed in $g/m^2$; BET (internal surface area) $m^2/g$; pore volume (ml/g); elastic rate ($kg/mm^2$); tensile strength ($kg/mm^2$); and ash content.

Activated carbons have different sized pores. Pores are referred to as micropores if their diameter is less than 20 angstroms (ideal for gas phase applications, and are of greatest significance for adsorption due to their very large specific surface area, and their large specific volume), mesopores when between 20 angstroms and 500 angstroms (ideal for liquid phase applications), and macropores when greater than 500 angstroms (ideal for large color bodies in liquid applications).

The specific surface area is measured by the BET method (the name being drawn from those of its inventors: Brunauer, Emmet and Teller). It consists of quantifying the pore surface of the activated carbon that is accessible to the molecules of a gas (nitrogen or argon). The value is expressed in $m^2/g$ of carbon. The larger the BET, the larger the surface area. Similarly, the larger the external surface area of the material, the more adsorption can take place.

Pore volume relates to the volume of micropores and can be used to determine the adsorbability of a particular entity. Also, elastic rate or elasticity is the greatest stress that can be applied to a material without causing permanent deformation.

The tensile strength is the ultimate strength of a material subjected to tensile loading. Thus, it is the maximum stress developed in a material during a tensile test.

Activated carbons can contain varying quantities of impurities, such as ash and humidity. Impurities can have an adverse affect on the application's performance and in the case of ash content, this residue creates a somewhat dirty/dusty product.

There are several devices that deal with the problems associated with intestinal discharges including devices that filter and/or capture intestinal exudations of various kinds. However, while those devices may be suitable for the purposes for which they were designed, the present invention provides an improved apparatus for adsorbing odors, such as body odors, including flatulence odor and/or genitalia odor and/or urine odor, to be worn close to the body of a user, as hereinafter described.

Typical of these devices are described in U.S. Pat. No. 4,182,335 of Matrullo, U.S. Pat. No. 4,490,145 of Campbell, U.S. Pat. No. 4,480,417 of Yabrov, U.S. Pat. No. 5,360,421 of Revelle, U.S. Pat. No. 5,665,081 of Grosse, U.S. Pat. No. 5,728,080 of Suyama, U.S. Pat. No. 5,957,907 of Oakley Sauer, U.S. Pat. No. 6,313,371 of Conant, et al. and U.S. Pat. No. 5,593,398 of Weimer.

U.S. Pat. No. 4,182,335 of Matrullo describes an anal filter for protecting underwear from soiling, is attached to a person's anus solely by non-adhesive adherence to the anus and adjacent portions of the buttocks, due to a facing of fluffy fibrous material, and when attached, serves as a filter by being pervious to the discharge of gas through the anus but substantially impervious to complete passage of excreta carried by the gas or remaining on the anus from a bowel movement. A layer may be adhesively secured to the fibrous material and which prior to use of the anal filter can be pulled off from the fibrous material while pulling this material's fibers outwardly so as to give the material its fluffy characteristic.

Also, U.S. Pat. No. 4,490,145 describes an ostomy pouch having a filter element affixed to the outer pouch wall. The outer pouch wall has an aperture and the filter element includes a polymeric film cover and an insert of gas deodorizing material. The film cover also has an aperture and opposite ends of the insert overlie the two apertures.

Further, U.S. Pat. No. 4,480,417 of Yabrov describes an anal pad for preventing soiling of underwear due to undesired anal discharge. The anal pad includes a thin outer shell enclosing a semi-rigid shell. The semi-rigid shell may be a layer on one interior surface of the outer shell and may also partially cover the opposite interior surface of the outer shell. An absorbing layer is located within the outer shell and the semi-rigid layer. The absorbing layer contains glycerin which absorbs hydrogen sulfide gas and the combination of the absorbing layer and the semi-rigid shell acts as a sound muffling camera so as to decrease the noise due to flatus. The absorbing layer is made of a light porous material, the semi-rigid layer is made of compressed paper and the outer shell is made of a thin sheet of lignin paper. A layer of glue is provided on the outer surface of the anal pad for attaching it to a user's underwear.

Moreover, U.S. Pat. No. 5,360,421 of Revelle describes a washable and reusable absorbent garment designed to be fitted about the waist and legs and covering the groin and anal areas of a wearer. The garment includes a number of superimposed layers of textile material sewn together along their edges. Elastic material may be sewn in the material around the leg openings and waist to improve the fit. A liner material covers the inner surface of the garment. The liner layer of the garment or that portion which is next to the wearer's skin is a knitted bicomponent textile comprised of a brushed polyester outer layer which is interknitted with a nylon block co-polymer inner layer. The materials function to transfer moisture in both vapor and liquid form from the polyester side to the nylon side where it is dispersed and made available to the garment's second or absorbent layer. The two specific materials in the liner adjacent the wearer's skin and absorbent material work together to maintain a high degree of comfort for the wearer even after it has been wetted. The structural and functional integrity of the garment is maintained after repeated washings.

Still another patent in this field is U.S. Pat. No. 5,665,081 of Grosse which relates to a pad for attenuating sound and absorbing odors from an anal region of an individual. The inventive device includes a pad member containing a volume of odor-absorbing granulated charcoal covered by a layer of filler material and encapsulated with a flexible web. A gluteus insert extends from the pad for positioning between the gluteus-maximus muscles and against the anal region of the user to attenuate noise emanating therefrom.

Another patent is U.S. Pat. No. 5,728,080 of Suyama which relates to a degassing device for an artificial anal bag which is capable of storing the gas generated in the intestines, and of discharging the gas from the bag at a selected place where degassing causes no nuisance to others. It comprises an elongated tube having a filter loaded therein, an opening-and-closing plug attached to its head end and a diverging joint formed at its tail end. The diverging joint can be attached to the circumference of a joint opening, which is made in the upper part of the bag. When the bag is inflated with gas and excreta from the intestines, the patient can go to the men's room or somewhere for discharging the gas from the bag. Then, the excreta and liquid content are prevented from passing through the filter, only permitting the gas to flow therethrough. Thus, degassing can be put under the perfect control by the patient, so that there is no fear of permitting leakage of gas to cause nuisance to others or imprignation of his underwear with unpleasant odor before the patient is aware.

Further, U.S. Pat. No. 5,957,907 of Sauer discloses an absorbent article that includes a close fitting bodyside liner having an opening therein. The opening defines a front end edge, a rear end edge, and a pair of laterally opposed side edges. The article also includes a pair of elastic members which extend longitudinally beyond at least one of the end edges of the opening in a laterally divergent direction. The elastic members may also extend at least partially along the side edges of the opening. The elastic members are configured to maintain the edges of the opening in contact with the wearer's buttocks and align the opening with the wearer's anal opening in use. The article may further include a liquid management material located on the bodyside liner in the front waist to absorb or contain liquid exudates.

U.S. Pat. No. 6,313,371 of Conant, et al. describes a flatulence deodorizer which purports to be the first product to use a washable and reusable activated charcoal cloth as a deodorizer because of its effectiveness and efficiency in removing odor such that the thickness of the cloth can be significantly reduced without losing its effectiveness. The filter is worn taped to the inside of briefs or panties and, because of its slim profile, the wearer is comfortable and virtually unaware of its presence.

Finally, U.S. Pat. No. 5,593,398 of Weimer discloses a protective underwear made of air tight polyurethane-coated nylon with an exit hole for the flatus is cut from the back, near the bottom of the underwear. The exit hole is covered with a pocket made of porous fabric, and designed in the same shape as the exit hole. The bottom layer of the pocket is sewn around the edge of the exit hole connecting it to the underwear. The top layer is sewn around the edge of the bottom layer and onto the underwear, except at the top, leaving the pocket opening.

The pocket opening is kept closed by a fastener. The replaceable filter is inserted inside the pocket. The top and bottom layers are wool felt and the second layers top and bottom are of polypropylene non woven fabric; followed by layers top and bottom of fiber glass wool. In the middle of the filter is a single layer of activated carbon.

While these devices may be suitable for the purposes for which they were designed, the present invention provides an improved garment for controlling odors, a method of making the garment and a method of controlling odors, as hereinafter described.

BRIEF DESCRIPTION OF THE INVENTION

Briefly stated, the present invention provides an apparatus which is an odor control nether garment, brief, panty or pad, as well as other embodiments, incorporating at least one outer fabric material layer and an inner layer of fiber fabric material for adsorbing odor to be worn by a user. More specifically, the present invention provides one or more of a lightweight, flexible, breathable, washable, regenerative and reusable apparatus for adsorbing odors, including flatulence, genitalia and urine odors, having a shape that conforms to at least one body part of a user. In one embodiment, the apparatus, a nether garment, has at least a waist opening and a pair of leg openings while covering at least the groin and/or anal areas of a user. Stretchable material may be joined to the material, for example, around the leg openings and/or waist to improve the fit against the body of a user.

The present invention does not require bulky replacement filter inserts to function, does not promote sweating and does not require laminating the inner layer of fabric material for adsorbing odor for structural support. Also, unlike known laminating techniques, peripheral joining of the outer fabric material layers to an inner layer of fiber fabric material for adsorbing odor will not block the inner layer of fiber fabric material pore structure. The inner layer of fiber fabric material for adsorbing odor is placed throughout the apparatus thereby providing improved odor control.

Also described in detail herein is a method for making an odor control nether garment without the need for laminating an inner layer of fiber fabric material for adsorbing odor to outer layers of fabric for support. As a result, the present invention provides a method for about 100% utilization of the available inner layer of fiber fabric material pore structure for odor adsorption while also maintaining the integrity of the apparatus when heat is applied to it.

A method of controlling odor is further described by using specific fabric materials in combination with the inner layer of fiber fabric material for adsorbing odor in order to maintain a high degree of comfort for the wearer as well as structural and functional integrity, even after it has been repeatedly washed and regenerated.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments, which are presently preferred. It should be understood, however, that the invention is not limited to the precise arrangements and instrumentalities shown.

In the drawings.

DETAILED DESCRIPTION OF THE INVENTION

Figure 1:
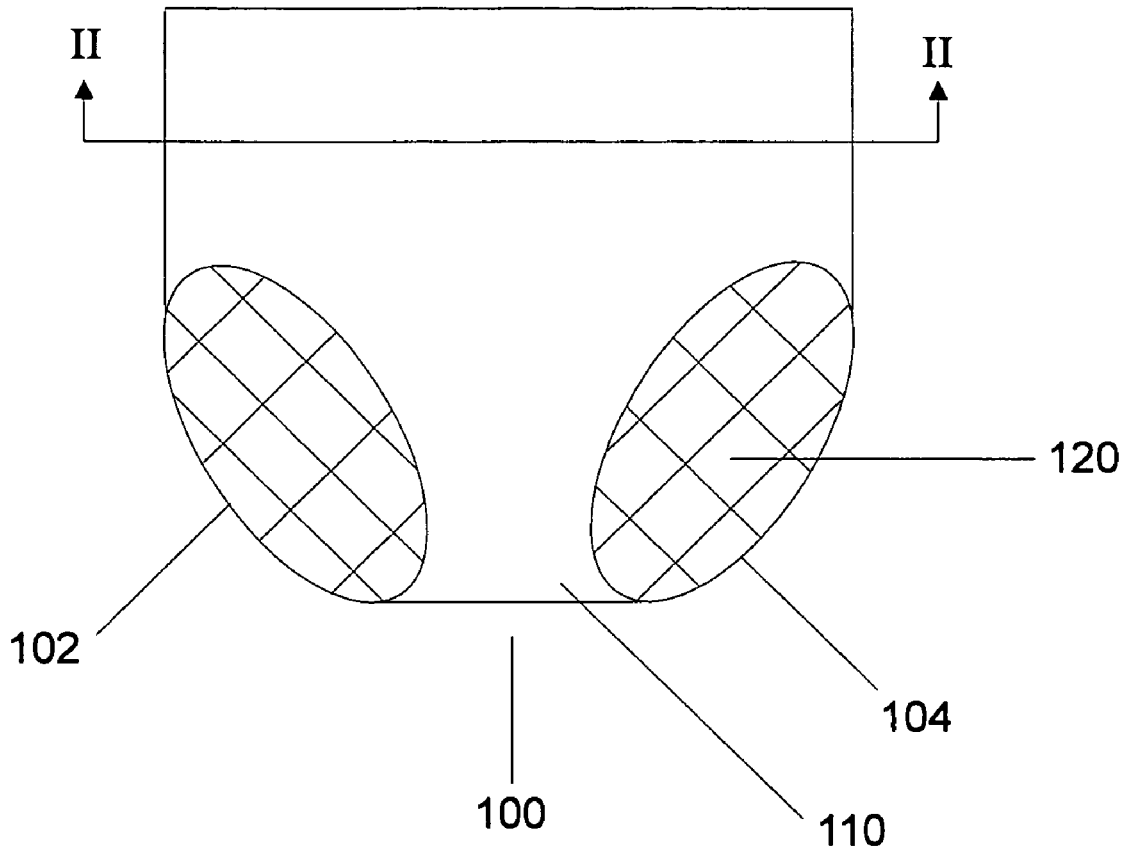
FIG. 1 is a perspective view, partially in cross section, of a nether garment for adsorbing odors to be worn close to the body of a user in accordance with a first embodiment of the present invention.

Certain terminology is used in the following description for convenience only and is not limiting. The words "right," "left," "lower," and "upper" designate directions in the drawings to which reference is made. The terminology includes the words above specifically mentioned, derivatives thereof and words of similar import.

The present invention overcomes the shortcomings of the prior art by providing a versatile apparatus for adsorbing odors including body odors, such as odors from flatulence and/or genitalia and/or urine, which is worn close to the body of a user. Preferably, the apparatus is a nether garment which is at least one of breathable, flexible, light weight, washable, permeable, regenerative and reusable. Most preferably, the apparatus includes all of the features of being breathable, flexible, light weight, washable, permeable, regenerative and reusable. The present invention does not require bulky replacement filter inserts to function, does not promote sweating and does not require laminating the inner layer of fiber fabric material for structural support. Unlike laminating techniques, peripheral joining of the outer fabric material layers to an inner layer of fiber fabric material will not block the inner layer of fiber fabric material pore structure. Further, the integrity of the nether garment is maintained both during and after the nether garment is exposed to excessive temperatures. The inner layer of fiber fabric material is, preferably, placed throughout the garment (for example, at the anal opening, front, back and sides) thereby providing improved odor control for the user.

Referring to the drawings, wherein like reference numerals are used to indicate like elements throughout, there is shown in FIG. 1 a first embodiment of the invention in perspective view, partially in cross section, of a nether garment 100, for adsorbing odors having a waist opening (not shown) and a pair of leg openings 102, 104, covering the groin and anal areas to be worn close to at least one body part of a user (not shown). The nether garment 100 includes at least one outer fabric material layer 110 which establishes the exterior of the nether garment 100 and an inner layer of fiber fabric material 120 for adsorbing odor. The outer fabric material layer 110 can, if desired, be used to form a pocket. The nether garment 100 is formed by joining the outer fabric material layer 110 to the inner layer of fiber fabric material 120 at, for example, the waist opening and at the pair of leg openings 102, 104. It will be understood by those of ordinary skill in the art that additional layers of outer fabric material can be included to form the nether garment within the scope of the present invention.

The nether garment 100 is constructed, preferably, such that the inner layer of fiber fabric material 120 is placed directly in contact with a portion of the body of the user. Preferably, the outer fabric material layer 110 comprises at least one of a nonwoven, cotton, textile and mixed fabric blend material. It is also preferred that the outer layer of fabric material 110 is a permeable and breathable fabric material. When a nonwoven material is used as the outer fabric material layer 110, it is preferably a spunbond polypropylene material with a basis weight of about 17 g/m$^2$ to about 88 g/m$^2$ and an air permeability rating of about 50 cfm/ft$^2$ to about 310 cfm/ft$^2$.

Preferably, the inner layer of fiber fabric material 120 is at least one of flexible, lightweight, breathable and permeable. It is also preferred that the inner layer of fiber fabric material 120 comprises at least one of paper, felt, preoxidized polyacrylonitrile acrylic-based fiber and nitrides materials. Most preferably, the fiber fabric material 120 comprises a preoxidized, polyacrylonitrile acrylic-based fiber and nitrides. When preoxidized polyacrylonitrile acrylic-based fiber and nitrides materials are employed, the nitride content is, preferably, about 5.5%, resulting in an improved inner layer of fiber fabric material for adsorbing sulphur compounds.

It is also preferred that the inner layer of fiber fabric material 120, in addition to comprising preoxidized polyacrylonitrile acrylic-based fiber and nitrides, be non-flammable at temperatures less than about 450-500° F. It is further preferred that the inner layer of fiber fabric material 120 is capable of being regenerated by applying heat to the nether garment 100. For example, a commercially available clothes dryer or hair dryer can be used for about 5-10 minutes at about 100-125° F., most preferably 7-10 minutes at 105-110° F., to regenerate the inner layer of fiber fabric material 120.

Preferably, the inner layer of fiber fabric material 120 comprises an activated carbon material. Most preferably, the activated carbon material is about 100% activated carbon. It is also preferred that the inner layer of fiber fabric material 120 is capable of being impregnated for additional catalytic, chemisorbing and bactericidal properties. It is further preferred that the inner layer of fiber fabric material 120 is about 75% to about 100% microporous. Most preferably, the fiber fabric material 120 is 90% to 100% microporous, with a pore diameter of about 10 angstroms to about 20 angstroms. An inner layer of fiber fabric material which is microporous is capable of adsorping odors due to the material's large specific surface area and large specific volume. For example, a micropore diameter of about 10 angstroms to about 20 angstroms results in a strong attractive force at the inner layer of a fiber fabric material's surface thereby accelerating molecules into the pore structure and enabling efficient as well as rapid pore-filling.

It is also preferred that the inner layer of fiber fabric material 120 have an internal surface area from about 700 m$^2$/g to about 2500 m$^2$/g, most preferably between 900 m$^2$/g and 2300 m$^2$/g. The internal surface area quantifies the pore surface of the inner layer of fiber fabric material that is accessible to adsorb a gas. The larger the surface area number, the larger the surface area for odor adsorption.

It is further preferred that the inner layer of fiber fabric material 120 have an external surface area from about 1.5 m$^2$/g to about 2.5 m$^2$/g, most preferably between 1.5 m$^2$/g and 2.0 m$^2$/g. Smaller particle diameters result in a higher surface area which significantly influences odor adsorption.

It is also preferred that the inner layer of fiber fabric material 120 have a pore volume of about 0.4 ml/g to about 1.5 ml/g, most preferably between 0.4 ml/g and 1.2 ml/g. Pore volume determines the adsorbability of the material. It is preferred that the inner layer of fiber fabric material 120 have a tensile strength of about 20 kg/mm$^2$ to about 50 kg/mm$^2$.

It is also preferred that the inner layer of fiber fabric material 120 have an elastic rate of about 6,500 kg/mm$^2$ to about 9,000 kg/mm$^2$, most preferably between 8,000 kg/mm$^2$ to about 8,200 kg/mm$^2$. Moreover, it is preferred that the inner layer of fiber fabric material 120 have a weight of about 100 g/m$^2$ to about 150 g/m$^2$.

It will be understood by those of ordinary skill in the art that not all of these preferred features of the inner layer of fiber fabric materials are necessary for the nether garment to work effectively.

Figure 2:
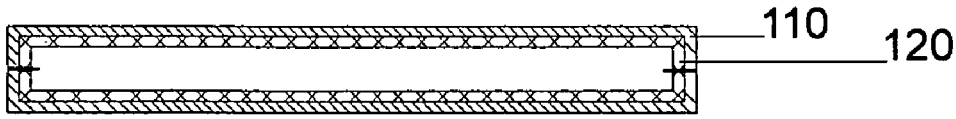
FIG. 2 is an enlarged cross-sectional view of a section of the apparatus of FIG. 1 taken along the line II-II of FIG. 1.

Referring now to FIG. 2, there is shown an enlarged cross-sectional view of a section of the nether garment of FIG. 1 taken along the line II-II of FIG. 1. FIG. 2 shows that the outer fabric material layer 110 establishes the exterior of the nether garment 100 and the inner layer of fiber fabric material 120 is in contact with the outer fabric material layer 110, for example, at the waist opening and pair of leg openings 102, 104.

Several different means of permanently contacting or joining the outer fabric material layer 110 to the inner layer of fiber fabric material 120 can be used effectively. Preferably, the layers 110, 120 are joined by at least one of stitching, adhesive bonding and/or heat sealing at conventional locations (not shown separately in the drawings) such as seams located, for example, at the waist opening and/or the pair of leg openings 102, 104. Stitching can be performed using, for example, cloth thread and a sewing-type machine or by hand. Several types of glues are known and available for joining fabric material, including activated carbon fiber fabric material. For example, Fabric-Tac™ is available from Beacon Chemical Co. Company, located in Mt. Vernon, N.Y. However, it will be recognized by those of ordinary skill in the art from this disclosure that other types of glues could be used, if desired, without departing from the spirit and scope of the invention. Hot melt adhesive bonding can be accomplished by applying heat to, for example, a glue known to be effective in joining fiber fabric materials. Various heat sealing means are known for joining fabrics which could be used, if desired, to join the outer fabric material layer 110 to the inner layer of fiber fabric material 120, including electronic sealing. It will be recognized by those of ordinary skill in the art from this disclosure that other types of joining means could be used, if desired, without departing from the spirit and scope of the invention.

Figure 3:
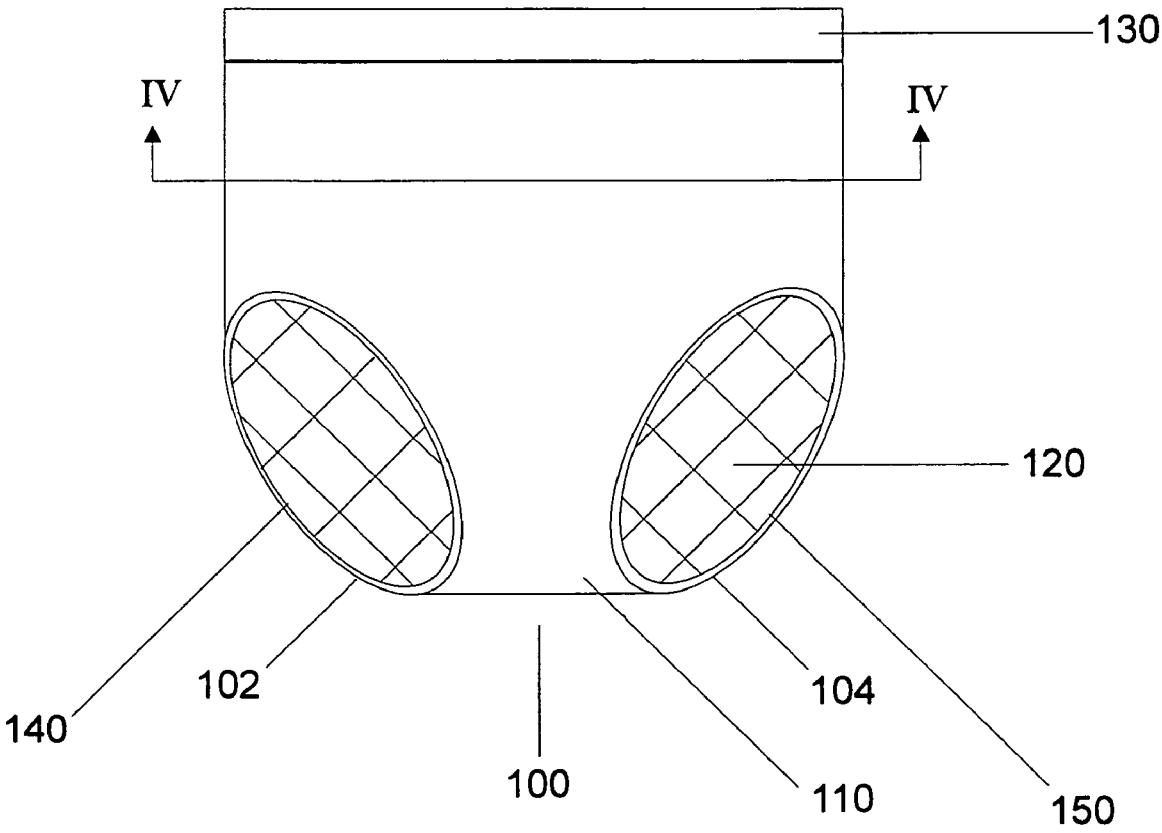
FIG. 3 is a perspective view, partially in cross section, of a nether garment similar to that shown in FIG. 1 further including a stretchable material.
Figure 4:
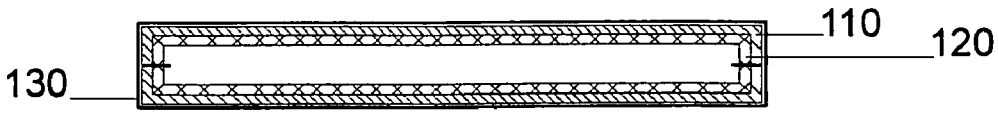
FIG. 4 is an enlarged cross-sectional view of a section of the apparatus of FIG. 3 taken along the line IV-IV of FIG. 3.

As shown in FIGS. 3 and 4 the embodiment shown in FIG. 1 can further comprise a stretchable material 130, preferably an elastic type material, which can be joined to the layers 110, 120 around the leg openings 102, 104 and waist. The stretchable material 130 is used to improve the fit of the nether garment 100 and to prevent odoriferous gas from easily escaping the garment 100. FIGS. 3 and 4 are intended to only differ from the first embodiment shown in FIGS. 1 and 2 in that the stretchable material 130 is joined to at least one of the outer fabric material 110 and the inner layer of fabric material around the waist opening and the leg openings 102, 104. It will be understood by those of ordinary skill in the art that it is not necessary to join the stretchable material 130 at all three of the waist and leg openings 102, 104, in order for the nether garment 100 to be effective.

It will also be recognized by those of ordinary skill in the art that the same means for permanently contacting or joining the fabric materials 110, 120 can be used to join the stretchable material 130. It will also be recognized by those of ordinary skill in the art from this disclosure that various types of attaching means can be used, if desired, including the use of snaps, buttons, draw strings or hook and loop fasteners, for example, in order to join the nether garment 100 to other objects, such as a user's pants, without departing from the spirit and scope of the invention.

Figure 5:
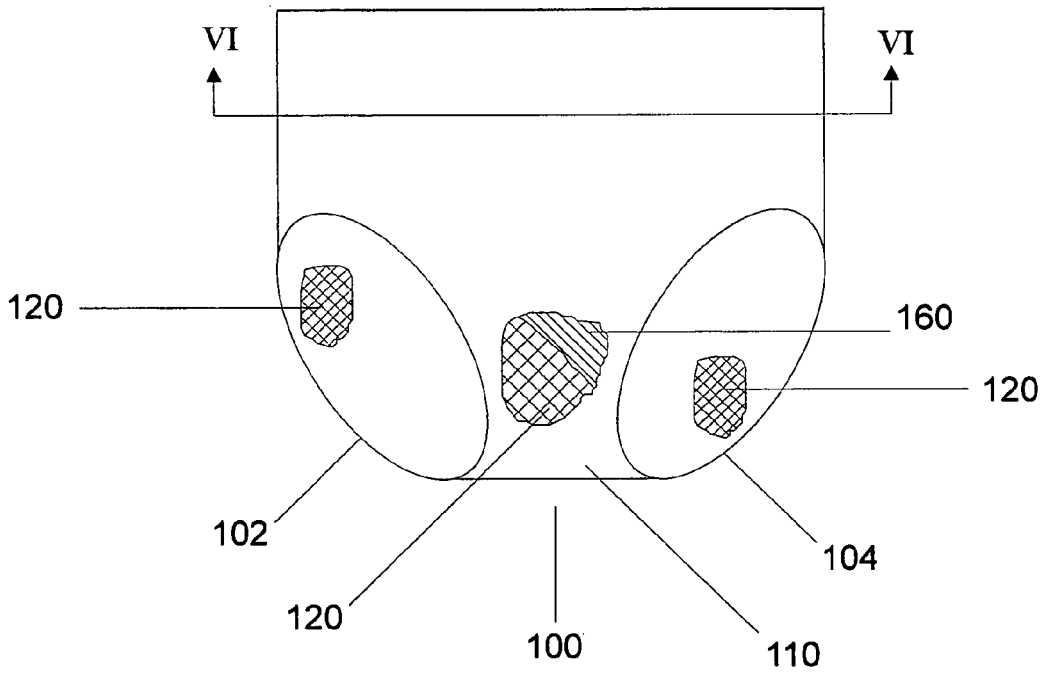
FIG. 5 is a perspective view, partially in cross section, of a nether garment similar to that shown in FIG. 1 further including a second outer fabric material layer.

Referring now to FIG. 5, the first preferred embodiment as shown in FIG. 1 for example, further comprises a second outer fabric material layer 160 which covers an exposed side of the inner layer of fiber fabric material 120. Preferably, the second outer fabric material 160 is placed directly in contact with a portion of the body of the user and is a permeable material. Most preferably, the second outer fabric material 160 comprises at least one of a nonwoven, cotton, textile and mixed fabric blend material. It is also preferred that the second outer fabric material layer 160 is a breathable fabric material. When a nonwoven is used as the second outer fabric material 160, it is preferably a spunbond polypropylene material with a basis weight of about 17 $g/m^2$ to about 88 $g/m^2$ and an air permeability rating of about 50 $cfm/ft^2$ to about 310 $cfm/ft^2$.

Figure 6:
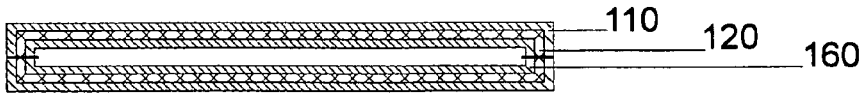
FIG. 6 is an enlarged cross-sectional view of a section of the apparatus of FIG. 5 taken along the line VI-VI of FIG. 5.

Referring now to FIG. 6, which is an enlarged cross-sectional view of a section taken along the line VI-VI of FIG. 5, the nether garment 100 is shown such that the outer fabric material layer 110 establishes a first exterior surface of the nether garment 100 and is joined to the inner layer of fiber fabric material 120, and is further joined to the second outer fabric material layer 160 establishing a second exterior surface of the nether garment 100.

Figure 7:
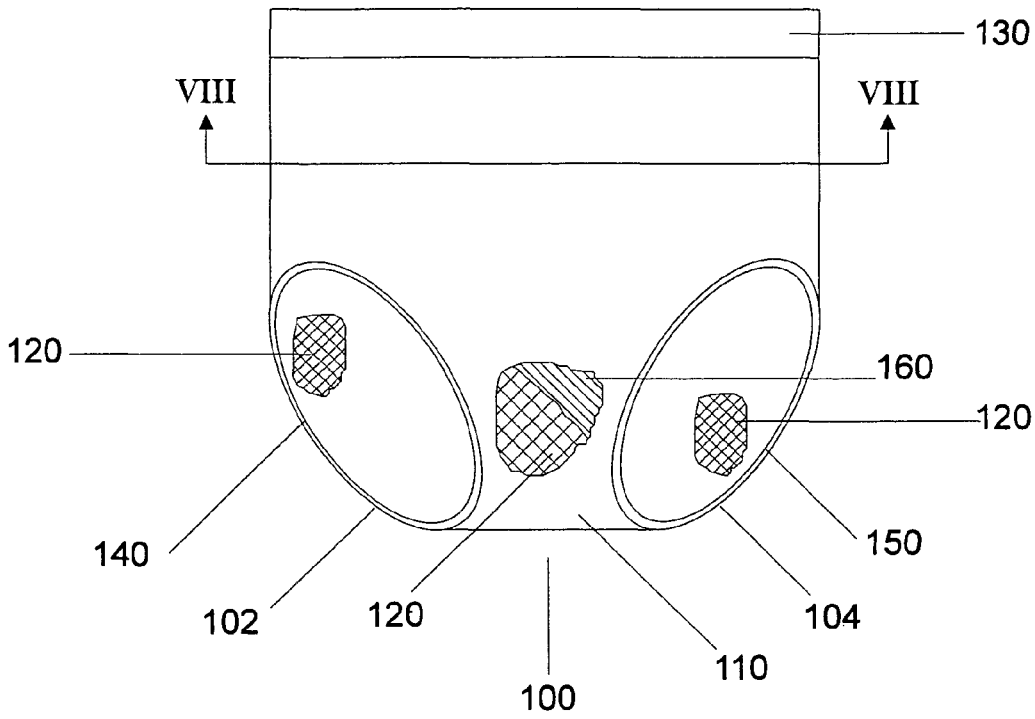
FIG. 7 is a perspective view, partially in cross section, of a nether garment similar to that shown in FIG. 5 further including a stretchable material.

As shown now in FIG. 7, the first embodiment as shown in FIG. 5 can further comprise the stretchable material 130 which is shown joined with the fabric materials 110, 120, 160 around the leg openings 102, 104 and waist in order to improve the fit and minimize air and odor bypass through the nether garment 100.

Figure 8:
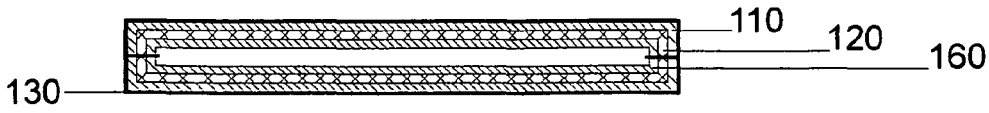
FIG. 8 is an enlarged cross-sectional view of a section of the apparatus of FIG. 7 taken along the line VIII-VIII of FIG. 7.

FIG. 8 is an enlarged cross-sectional view of a section taken along the line VIII-VIII of FIG. 7 and shows the stretchable material 130 joined with the fabric materials 110, 120, 160 around the waist of the nether garment 100.

Figure 9:
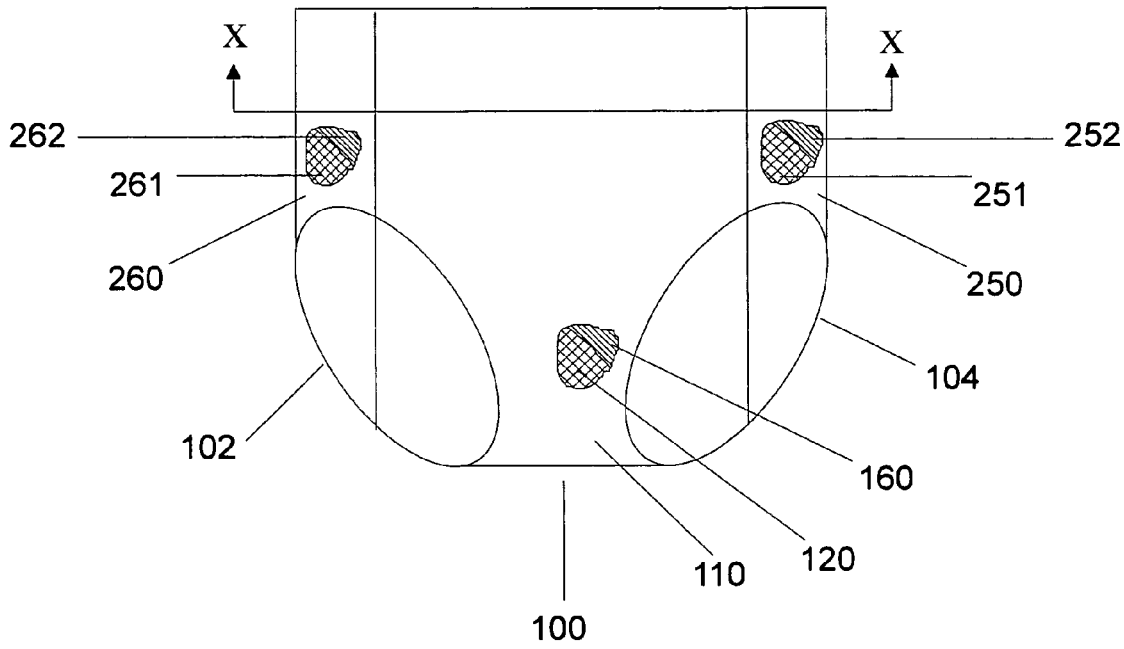
FIG. 9 is a perspective view, partially in cross section, of a nether garment similar to that shown in FIG. 5 further including a central panel assembly and side assemblies.
Figure 10:
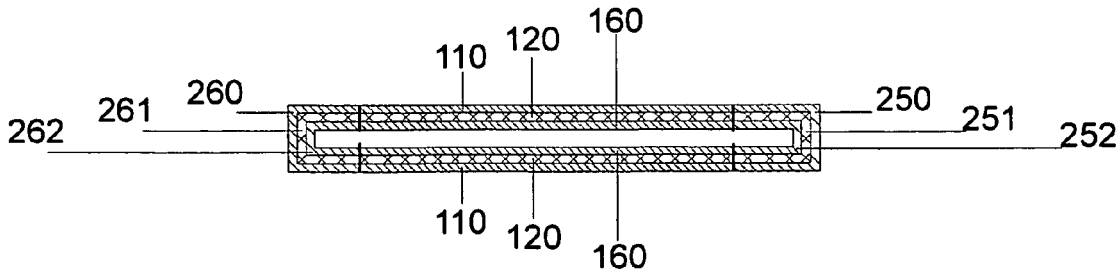
FIG. 10 is an enlarged cross-sectional view of a section of the apparatus of FIG. 9 taken along the line X-X of FIG. 9.

Referring now to FIGS. 9 and 10, the nether garment 100 is shown further comprising a right side of fabric materials 250, 251, 252 and a left side of fabric materials 260, 261, 262 joined together to form the nether garment 100 with a waist opening (not shown) and a pair of leg openings 102, 104. FIG. 9 is intended to only differ from the embodiment shown in FIG. 5 in that the embodiment further comprises sides of fabric materials 250, 251, 252, 260, 261, 262. Preferably, the sides of fabric material 250, 251, 252, 260, 261, 262 are at least one of a breathable and expandable fabric material. It is also preferred that the side panels of fabric material 250, 251, 252, 260, 261, 262 are at least one of a cotton, textile and mixed fabric blend material. It will be understood by those of ordinary skill in the art from this description and from FIGS. 1-8 that fabric materials 250, 252, 260, 262 are outer fabric material layers as previously described. Also, fabric materials 251, 261 are inner layers of fiber fabric material as previously described. It will be further understood by those of ordinary skill in the art that the left and right sides 250, 251, 252, 260, 261, 262 can be formed, if desired, with only one outer fabric material layer 250, 260 on either side of the nether garment 100.

FIG. 10 is an enlarged cross-sectional view along the line X-X of FIG. 9. The nether garment 100 is shown such that it is comprised of an outer fabric material layer 110, an inner layer of fiber fabric material for adsorbing odor 120 and a second outer layer of fabric material 160. The right side panel of the nether garment 100 is comprised of an outer fabric material layer 250, an inner layer of fiber fabric material for adsorbing odor 251 and a second outer fabric material layer 252. The left of the nether garment 100 is comprised of an outer fabric material layer 260, an inner layer of fiber fabric material for adsorbing odor 261 and a second outer fabric material layer 262. The nether garment 100 is joined at the right side of the fabric materials 250, 251, 52 and to the left side of the fabric materials, 260, 261, 262 such that these is a waist opening (not shown), and a pair of leg openings 102, 104.

Figure 11:
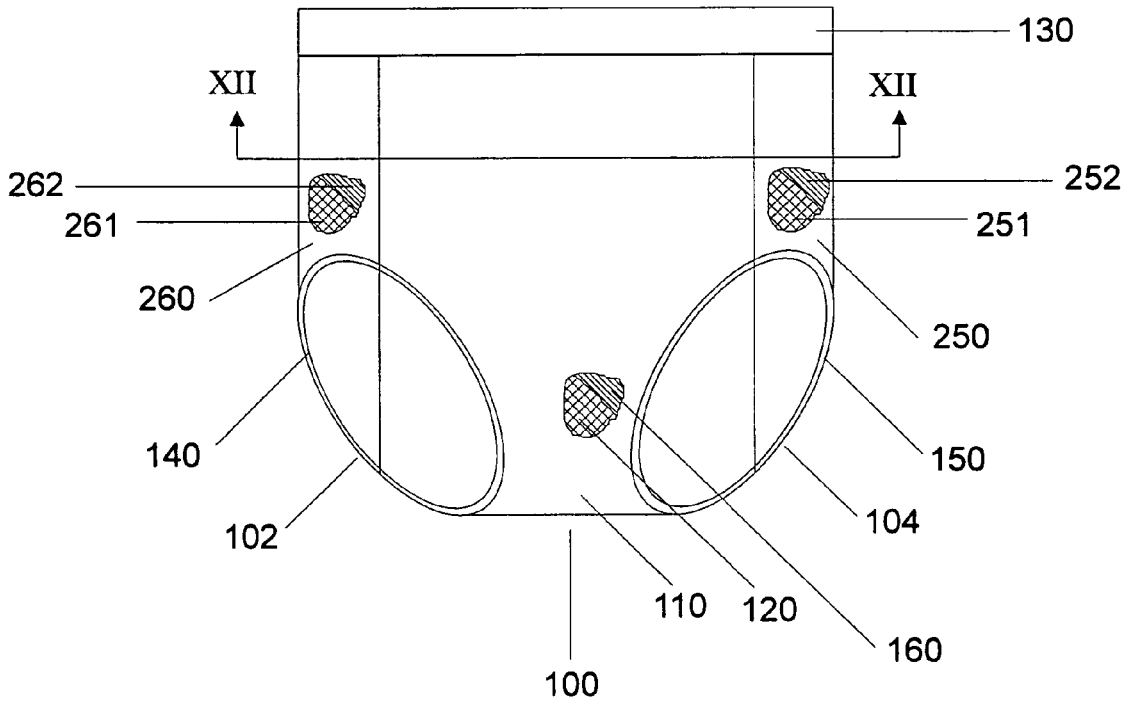
FIG. 11 is a perspective view, partially in cross section, of a nether garment similar to that shown in FIG. 9 further including a stretchable material.
Figure 12:
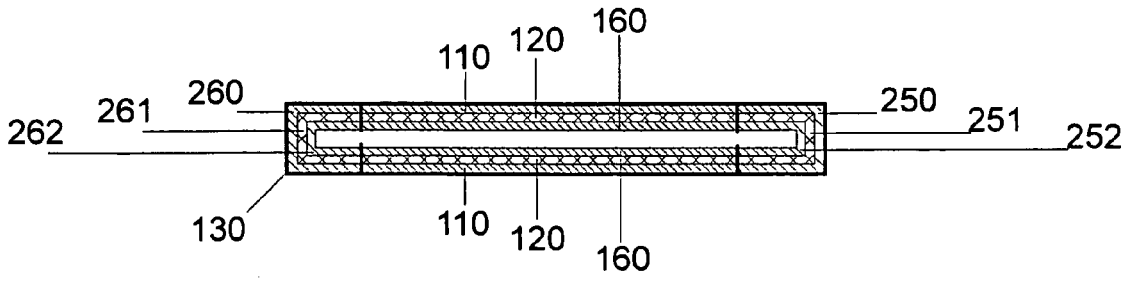
FIG. 12 is an enlarged cross-sectional view of a section of the apparatus of FIG. 11 taken along the line XII-XII of FIG. 11.

FIGS. 11 and 12 are intended to only differ from FIGS. 9 and 10 in that the embodiment has the stretchable material 130 which is, preferably an elastic material joined around the waist and the pair of leg openings 102, 104. It will be understood by one of ordinary skill in the art that it is not necessary to have the leg openings 102, 104 of the nether garment 100 joined by the stretchable material 130 in order for the nether garment to function effectively. As previously stated, it will also be recognized by those of ordinary skill in the art from this disclosure that various types of attaching means could be used, if desired, including the use of snaps, buttons, draw strings or hook and loop fasteners for example, without departing from the spirit and scope of the invention.

Figure 13:
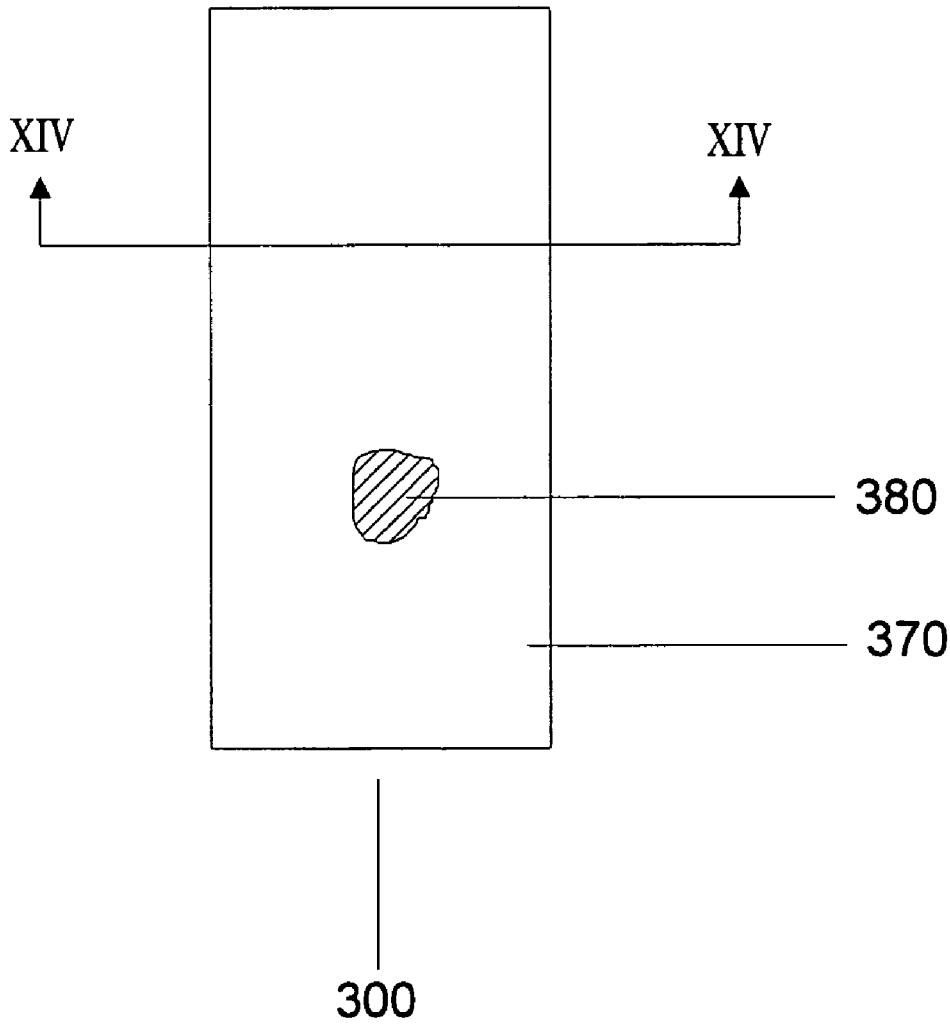
FIG. 13 is a perspective view, partially in cross section, of a nether garment for adsorbing odors to be worn close to the body of a user in accordance with a second embodiment of the present invention.
Figure 14:
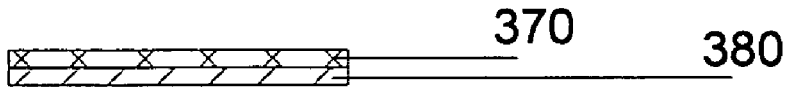
FIG. 14 is an enlarged cross-sectional view of a section of the apparatus of FIG. 13 taken along the line XIV-XIV of FIG. 13.

A second embodiment of the present invention, is shown in FIGS. 13 and 14 where a nether garment 300 comprises at least one outer fabric material layer 370 and an inner layer of fiber fabric material 380 for adsorbing odor such that the inner layer of fiber fabric material 380 can be placed directly in contact with a portion of a body of a user. Generally, it is preferred that the outer fabric material layer 370 and the inner layer of fiber fabric material have all of the previously described preferred features of the outer fabric material layer 110 and the inner layer of fiber fabric material 120, respectively. For example, the outer fabric material layer 380 is, preferably, a permeable material and, most preferably, comprises at least one of a nonwoven, cotton, textile and mixed fabric blend material. It is also preferred that the outer layer of fabric material 110 is a breathable fabric material. When a nonwoven is used as an outer fabric material layer 110, it is preferably a spunbond polypropylene material with a basis weight of about 17 to about 88 g/m$^2$ and an air permeability rating of about 50 cfm/ft$^2$ to about 310 cfm/ft$^2$. It is also preferred, for example, that the inner layer of fiber fabric material 380 comprises activated carbon material and is regenerable by heat.

Thus, the second preferred embodiment shown in FIGS. 13 and 14 is intended to only differ from the first embodiment shown, for example, in FIGS. 1 and 2 in that nether garment 300 is intended to cover the anus and/or the genitalia area and to extend up towards the front and back of a body of a user, ending at about the waist of the body of the user. As previously discussed, several different means of joining the nether garment 300 to other objects worn by the user can be used effectively.

Figure 15:
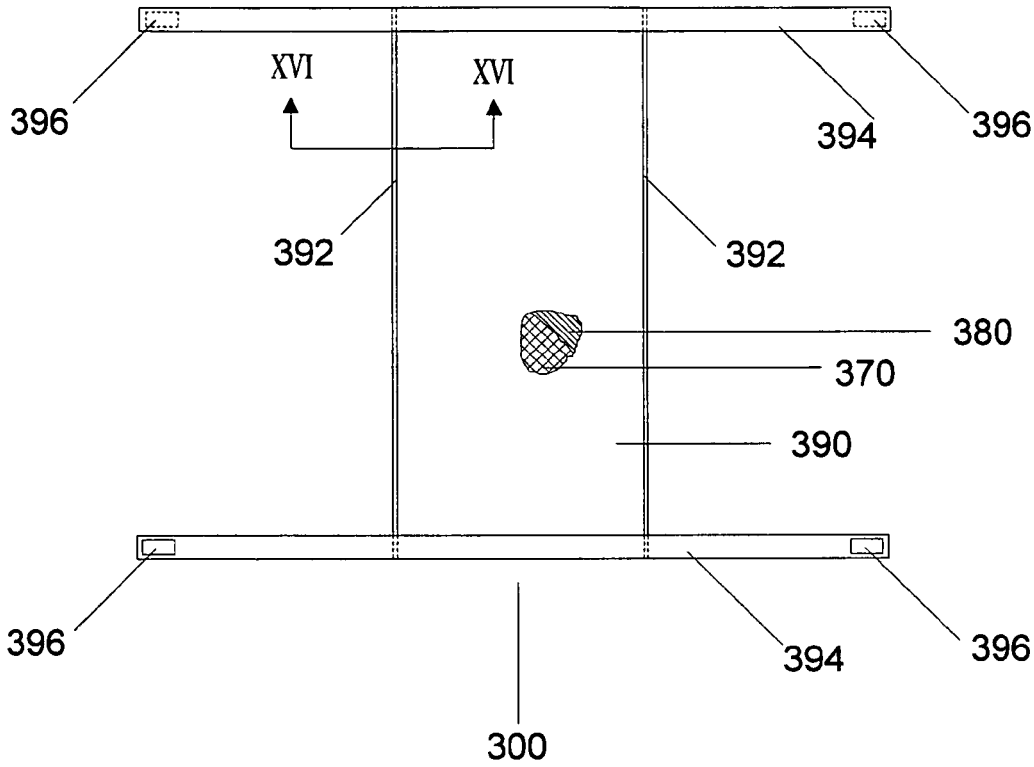
FIG. 15 is a perspective view, partially in cross section, of a nether garment similar to that shown in FIG. 13 further including a second outer fabric material layer and a stretchable material.
Figure 16:
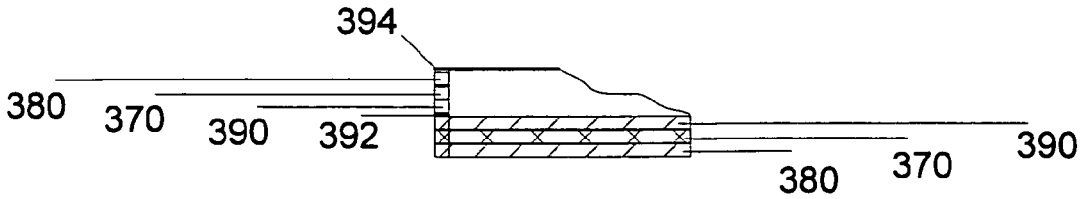
FIG. 16 is an enlarged cross-sectional view of a section of the apparatus of FIG. 15 taken along the line XVI-XVI of FIG. 15.

As shown in FIGS. 15 and 16, the nether garment 300 further comprises a second outer fabric material layer 390 covering an exposed side of the inner layer of fiber fabric material 380 for adsorbing odor, in addition to the outer fabric material layer 370. Also shown in FIGS. 15 and 16 is a stretchable material 392, 394 on the top and bottom of the nether garment 300 and on the sides of the nether garment 300.

FIGS. 15 and 16 are intended to only differ from the embodiment shown in FIGS. 13 and 14 in that the second outer fabric material layer 390 covers an exposed side of the inner layer of fiber fabric material 380, for adsorbing odor and the elastic material 392, 394 joins the top, bottom and sides of the nether garment 300. Additionally, as shown in FIG. 15, an attachment means 396 at each end of the stretchable material 394 is included in the embodiment in order to, for example, secure the nether garment around the waist of a body of a user. If desired, the second outer fabric material layer 390 can be placed directly in contact with a portion of the body of the user. Preferably, the second outer fabric material layer 390 is a permeable material and, most preferably, comprises at least one of a nonwoven, cotton, textile and mixed fabric blend material. It is also preferred that the outer fabric material layers 37 and 390 are a breathable fabric material. When a nonwoven fabric is used as the outer layer fabric materials 370, 390, it is preferably a spunbond polypropylene material with a basis weight of about 17 to about 88 g/m$^2$ and an air permeability rating of about 50 cfm/ft$^2$ to about 310 cfm/ft$^2$.

FIG. 16, which is an enlarged cross-sectional view of a section of the apparatus of FIG. 15 taken along the line XVI-XVI of FIG. 15, shows the nether garment 300 wherein the outer fabric material layer 370 establishes an exterior of the nether garment 300 and is joined to the inner layer of fiber fabric material for adsorbing odor 380 and is further joined to the second outer fabric material layer 390. The stretchable material 394 is joined to the top and bottom of the nether garment 300 and at each end of the stretchable material 394, an attaching means 396 is joined to allow for easy placement around, for example, the waist of a user. A stretchable material 392 is also shown joined to the sides of the nether garment 300 and further joined to the top and bottom of the nether garment 100. Various means for joining the stretchable material 392, 394 and for attaching the nether garment to the user have been previously described.

It will be understood by those of ordinary skill in the art from the description provided that other embodiments are within the scope of the present invention and include nether garments which control foot odor in the form of a sock and/or slipper which comprise an outer fabric material layer covering an exposed side of an inner layer of fiber fabric material for adsorbing odor and a second outer fabric material layer. The first outer fabric material layer is joined to the inner layer of fiber fabric material at its perimeter and is further joined to the second outer material layer at its perimeter having a foot opening. If desired, the opening is banded with a stretchable material, for example a plastic material, for user comfort and odor containment, permitting the foot odor to pass through the inner layer of fiber fabric material for adsorbing odor. The inner fabric material has been previously described above. The outer fabric material layer can be placed, preferably, directly in contact with a portion of the body of the user and is, preferably, a permeable material and, most preferably, comprises at least one of a nonwoven, cotton, textile and mixed fabric blend material. It is also preferred that the outer fabric material layer is a breathable fabric material. When a nonwoven is used as an outer layer fabric material, it is preferably a spunbond polypropylene material with a basis weight of about 17 to about 88 g/m$^2$ and an air permeability rating of about 50 cfm/ft$^2$ to about 310 cfm/ft$^2$.

In another embodiment of the present invention, the nether garment has a shape for use as an under arm odor control apparatus in the form of a pad which comprises an outer fabric material layer covering an exposed side of an inner layer of fiber fabric material for adsorbing odor and a second outer fabric material layer. The first outer fabric material layer is joined to the inner layer of fiber fabric material at its perimeter and is further joined to the second outer material layer at its perimeter. The outer fabric material layer can be placed, preferably, directly in contact with a portion of the body of the user and is a permeable material and, most preferably, comprises at least one of a nonwoven, cotton, textile and mixed fabric blend material. It is also preferred that the outer fabric material layer is a breathable fabric material. When a nonwoven is used as an outer layer fabric material, it is preferably a spunbond polypropylene material with a basis weight of about 17 to about 88 g/m$^2$ and an air permeability rating of about 50 cfm/ft$^2$ to about 310 cfm/ft$^2$.

In another embodiment of the present invention, the nether garment has a shape which can be used effectively for odor control in the form of a pad and/or a blanket which comprises an outer fabric material layer covering an exposed side of an inner layer of fiber fabric material for adsorbing odor and a second outer fabric material layer. The first outer fabric material layer is joined to the inner layer of fiber fabric material at its perimeter and is further joined to the second outer material layer at its perimeter. The outer fabric material layer can be placed, preferably, directly in contact with a portion of the body of the user and is a permeable material and, most preferably, comprises at least one of a nonwoven, cotton, textile and mixed fabric blend material. It is also preferred that the outer fabric material layer is a breathable fabric material. When a nonwoven is used as an outer layer fabric material, it is preferably a spunbond polypropylene material with a basis weight of about 17 to about 88 g/m$^2$ and an air permeability rating of about 50 cfm/ft$^2$ to about 310 cfm/ft$^2$.

In another embodiment of the present invention, the nether garment is in the form of a sealable pouch and/or bag and comprises an outer fabric material layer covering an exposed side of an inner layer of fiber fabric material for adsorbing odor and a second outer fabric material layer. The first outer fabric material layer is joined to the inner layer of fiber fabric material at its perimeter and is further joined to the second outer material layer at its perimeter. The embodiment is further joined on the sides and bottom with a top opening that is further banded with an elastic material and/or a zipper. The outer fabric material layer is a permeable material and, most preferably, comprises at least one of a nonwoven, cotton, textile and mixed fabric blend material. It is also preferred that the outer fabric material layer is a breathable fabric material. When a nonwoven is used as an outer layer fabric material 370, it is preferably a spunbond polypropylene material with a basis weight of about 17 to about 88 g/m$^2$ and an air permeability rating of about 50 cfm/ft$^2$ to about 310 cfm/ft$^2$.

As with the previously described nether garment embodiments, it is preferred that the embodiments just described are flexible, lightweight, regenerable, breathable and permeable.

Another aspect of the present invention is to provide a method of making a nether garment for adsorbing odor to be worn close to at least one body part of a user, joining at least one outer fabric material layer to an inner layer of fiber fabric material and conforming the at least one outer fabric material layer and the inner layer of fiber fabric material to a shape of the at least one body part of the user. As previously described, the nether garment, made by the process just described can have waist opening, a pair of leg openings and cover, for example, the groin and anal areas of a user. The method can further comprise banding the openings with a stretchable material and conforming the nether garment to the shape of the body of a user. The method of the present invention is intended to produce the nether garment described herein, including the various embodiments described above, and therefore, the features of the nether garment previously described are incorporated herein by reference.

Still another object of the present invention is to provide a method of making a washable and reusable nether garment for adsorbing odors such as flatulence and/or genitalia and/or urine odor to be worn close to the body of a user having all of the features of the nether garment previously described. This method is intended to produce the apparatus described herein, including the various embodiments of the apparatus, and therefore, the features of the apparatus previously described are incorporated herein by reference.

Still another aspect of the present invention is to provide a method of controlling and adsorbing odors such as flatulence and/or genitalia and/or urine odors, by making the nether garment previously described and properly placing it against the body of a user such that the nether garment effectively and efficiently adsorbs odors. More specifically, the method comprises joining at least one outer fabric material layer to an inner layer of fiber fabric material, conforming the at least one outer fabric material layer and the inner layer of fiber fabric material to a shape of at least one body part of a user to form a nether garment, and placing the nether garment in a vicinity of the at least one body part of a user. If desired, the method can further comprise the step of regenerating the inner layer of the fiber fabric material by applying heat to the nether garment and/or further comprise at least one of the steps of washing and reusing the nether garment.

It will be appreciated by those skilled in the art that changes could be made to the embodiments and methods described above without departing from the broad inventive concept thereof. Additional embodiments include, but are not limited to, apparatus which can be used in such applications as colostomy bag depressurization. The method of manufacturing and the referenced layers of inner and outer fiber fabric materials are used in different geometric configurations to suit the referenced applications with similar joining methods as referenced throughout this description. It is understood, therefore, that this invention is not limited to the particular embodiments or methods disclosed, but it is intended to cover modifications within the spirit and scope of the present invention as defined by the appended claims.

I claim:

1. A nether garment for adsorbing odor to be worn close to at least one body part of a user, comprising:

a) at least one permeable outer fabric material layer; and b) an inner layer of activated carbon fiber fabric material for adsorbing odor located throughout a majority of the nether garment, wherein the inner layer of activated carbon fiber fabric material is regenerable and comprises a preoxidized, polyacrylonitrile fiber material and a material having about 5.5% nitrides by weight, and wherein a majority of the nether garment is permeable and breathable, and conforms to a shape of the at least one body part of the user.

2. A nether garment for adsorbing odor to be worn close to at least one body part of a user, consisting of:

a) two permeable outer fabric material layers; and b) an inner layer of activated carbon fiber fabric material for adsorbing odor situated between the two permeable outer fabric material layers and located throughout a majority of the nether garment, wherein the inner layer of activated carbon fiber fabric material is regenerable and comprises a preoxidized, polyacrylonitrile fiber material and a material having nitrides, and wherein a majority of the nether garment is permeable and breathable, and conforms to a shape of the at least one body part of the user.

3. An odor adsorbing garment comprising:

a) an outer fabric material and an inner fabric material which form front and back portions of the garment and which have a shape that forms a waist opening and two leg openings;

b) an activated carbon fiber fabric material for adsorbing odor between the outer and inner fabric materials and about the same size and shape as the outer and inner fabric materials;

c) elastic bands separately formed around the circumference of the waist opening and the two leg openings, wherein perimeters of the outer fabric material, the inner fabric material and the activated carbon fiber fabric material are joined together with the elastic bands, wherein the activated carbon fiber fabric material is regenerable and comprises a preoxidized, polyacrylonitrile fiber material and a material having nitrides, and wherein the outer fabric material, the inner fabric material and activated carbon fiber fabric material are permeable and breathable.

4. A nether garment for adsorbing odor to be worn close to at least one body part of a user, comprising:

a) at least one permeable outer fabric material layer; and b) an inner layer of activated carbon fiber fabric material for adsorbing odor located throughout a majority of the nether garment, wherein the outer layer is a non-woven, spunbound polypropylene material, wherein the inner layer of activated carbon fiber fabric material comprises a preoxidized, polyacrylonitrile fiber material and a material having about 5.5% nitrides by weight, is heat regenerable, has a pore volume of about 0.4 ml/g to about 1.5 ml/g, a tensile strength of about 20 kg/mm$^2$ to about 50 kg/mm$^2$, and is about 75% to about 100% microporous, and wherein a majority of the nether garment is permeable and breathable, and conforms to a shape of the at least one body part of the user.

5. A nether garment for adsorbing odor to be worn close to at least one body part of a user, comprising:

a) at least one permeable outer fabric material layer; and b) an inner layer of activated carbon fiber fabric material for adsorbing odor located throughout a majority of the nether garment, wherein the outer layer is a non-woven, spunbound polypropylene material, wherein the inner layer of activated carbon fiber fabric material is regenerable and comprises a preoxidized, polyacrylonitrile fiber material and a material having nitrides, and wherein a majority of the nether garment is permeable and breathable, and conforms to a shape of the at least one body part of the user.

6. The nether garment of claim 5, wherein the outer layer has a basis weight of 17 $g/m^2$ to about 88 $g/m^2$ and an air permeability rating of about 50 $cfm/ft^2$ to about 310 $cfm/ft^2$.

* * * * *